US007037641B2

(12) United States Patent
Kuwabara

(10) Patent No.: US 7,037,641 B2
(45) Date of Patent: May 2, 2006

(54) SILVER HALIDE EMULSION SHEET FOR DETECTING TRACK OF CHARGED ELEMENTARY PARTICLES, AND PROCESSING METHOD THEREOF

(75) Inventor: Ken-ichi Kuwabara, Minami-ashigara (JP)

(73) Assignee: Fuji Photo Film Co.,Ltd., Minami-ashigara (JP)

( * ) Notice: Subject to any disclaimer, the term of this patent is extended or adjusted under 35 U.S.C. 154(b) by 0 days.

(21) Appl. No.: 11/131,187

(22) Filed: May 18, 2005

(65) Prior Publication Data

US 2005/0233267 A1 Oct. 20, 2005

Related U.S. Application Data

(62) Division of application No. 10/244,671, filed on Sep. 17, 2002, now Pat. No. 6,916,600.

(30) Foreign Application Priority Data

Sep. 19, 2001 (JP) ..... 2001-285962

(51) Int. Cl.
*G03C 1/34* (2006.01)
*G03C 5/30* (2006.01)
*G03C 5/16* (2006.01)

(52) U.S. Cl. ..... 430/502; 430/606; 430/614; 430/483; 430/942; 430/953; 250/475.2

(58) Field of Classification Search ..... 430/440, 430/483, 502, 614, 606, 953, 966, 942; 250/475.2
See application file for complete search history.

(56) References Cited

U.S. PATENT DOCUMENTS 3,025,162 A 3/1962 Gilbert
3,031,304 A 4/1962 Oliver
5,472,834 A 12/1995 Florens et al.
5,578,433 A 11/1996 Morishima et al.
5,948,602 A 9/1999 Yamashita et al.
5,965,337 A 10/1999 Droin et al.
6,077,652 A 6/2000 Hosoi
6,489,090 B1 12/2002 Haye et al.
6,528,227 B1 3/2003 Zegel et al.
6,630,278 B1 10/2003 Zegel et al.

*Primary Examiner*—Richard L. Schilling
(74) *Attorney, Agent, or Firm*—Birch, Stewart, Kolasch & Birch, LLP

(57) ABSTRACT

A silver halide emulsion sheet for detecting track of charged elementary particles, in which emulsion at least one silver halide emulsion layer and at least one hydrophilic protective colloid layer are applied on both surfaces of a transparent support, and a compound selected from benzotriazoles is contained in said at least one silver halide emulsion layer.

A processing method for processing the above-described silver halide emulsion sheet with a developer comprising a developing agent represented by formula (A):

formula (A)

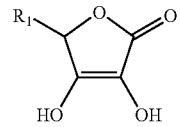

wherein $R_1$ represents a hydrogen atom, an alkyl group, an aryl group, or a heterocyclic group.

A developer for use in developing the above-described silver halide emulsion sheet, comprising a developing agent represented by the above-mentioned formula (A).

10 Claims, No Drawings

SILVER HALIDE EMULSION SHEET FOR DETECTING TRACK OF CHARGED ELEMENTARY PARTICLES, AND PROCESSING METHOD THEREOF

This application is a Divisional of application Ser. No. 10/244,671, filed on Sep. 17, 2002 now U.S. Pat. No. 6,916,600, and for which priority is claimed under 35 U.S.C. § 120; and this application claims priority of Application No. 2001-285962 filed in JAPAN on Sep. 19, 2001 under 35 U.S.C. § 119; the entire contents of all are hereby incorporated by reference.

FIELD OF THE INVENTION

The present invention relates to a silver halide emulsion sheet that is a nuclear plate for use in detecting and recording track of charged elementary particles. The present invention also relates to a processing method of the silver halide emulsion sheet.

BACKGROUND OF THE INVENTION

Nuclear plates have been used as a means of recording track of charged elementary particles in cosmic rays or in nuclear reaction, to make analytical researches in their characteristics (*Kagaku Shashin Binran* (*Science Photography Handbook*), Vol. I, Paragraph 11.4; Vol. II, Paragraph 4.1 (Maruzen); and *Butsurigaku Sensho* 7 *Hoshasen Keisokugaku* (*Physics selection* 7 *Radiation Metrology*), Chapter 6, Paragraph 3 (Shoukabo Gomei Kaisha)).

Generally, a nuclear plate comprises a coated silver halide emulsion, of tens of μm to hundreds of μm thickness, in high density on one or both surfaces of a transparent support, such as a glass plate and a plastic film.

In the nuclear plate, charged elementary particles that pass through silver halide crystals of a silver halide emulsion, give energy to the silver halide crystals, and as a result, latent images are formed in the crystals due to the electrons generated on the ionization. As to the charged particles, such as electron rays and α-rays, latent images are formed in the silver halide grains in accordance with tracks of charged particles. On the other hand, as to γ-rays and X-rays, latent images are not directly formed in accordance with tracks of these rays, but with tracks of electrons generated by photoelectric effect, Compton effect, or the like.

The nuclear plate having a latent image formed is processed to visualize the image as black silver. The visualized black silver grains are investigated by means of an optical microscope, to detect tracks of the particles, thereby identifying kinds and properties of the charged particles.

The nuclear plate that can directly capture π meson, muon, τ-particles, Charm particles, and the like, remarkably contributed to the progress of elementary particle physics.

The silver halide emulsion for a nuclear plate that is to be used as mentioned above is required to exhibit a photographic property that is high in the number of developed silver grains formed per unit length of track, while considerably low in fog. Generally, the number of developed silver grains referred to as Grain Density (=GD) and means the number of developed silver per 100 μm of a track that an electron-ray of a minimum ionizing particle forms. Fog is represented by the number of fogged grains per 1000 $\mu m^3$ and is referred to as Fog Density (=FD). For the above-mentioned purpose, generally, use has been made of emulsions in which silver bromide or silver iodobromide particulate crystals, of uniform size, are densely dispersed in a gelatin binder.

In the nuclear plate, latent images are accumulatively formed upon exposure to natural radiation and cosmic rays in the period of time between coating of a silver halide emulsion on a support and use of the coated silver halide emulsion for investigation. The resulting latent images inevitably form tracks that become harmful noises in a track analysis for a target charged particle of interest. Accordingly, to make the influence of undesired exposure as small as possible, there has been employed a method in which a researcher coats a silver halide emulsion, in a laboratory, just before starting experimentation, and then uses the obtained plate. However, this method is not satisfactory because of such disadvantages that much labor is required and uniform coating is difficult.

In view of the above, there has been developed, for example, a method in which a treatment called refresh treatment (forced fading treatment) is carried out before use. The refresh treatment is to eliminate latent images formed by cosmic rays and accumulated in the coated dry plate before starting experimentation (elimination of Background-Track).

However, previous silver halide emulsions provided for the nuclear plate have such disadvantages as that, by a fading treatment, a latent image is not sufficiently eliminated, fog is increased, or, even though a latent image is sufficiently eliminated, the objective sensitivity after the treatment decreases. Accordingly, there is strong demand for a nuclear plate that is excellent in fading treatment suitability.

Further, previous nuclear plates have such problems as that, in the case of handling a lot of nuclear plates, abrasion marks (fog) easily increase, and dry plates easily adhere with each other, and also, in the case of a glass plate, the dry plate is heavy and breaks easily.

Besides, previous nuclear plates may be processed using a methol/hydroquinone series developer, which is used in a processing of black and white photographic light-sensitive material. However, in the case of processing a nuclear plate coated with a thick emulsion layer, the general method is to use amidol as a developing agent, and conduct development at a low pH and a low temperature for a long time (see *Kagaku Shashin Binran* (*Science Photography Handbook*), Vol. II, Paragraph 4.1, pp. 140 to 141 (Maruzen); *Butsurigaku Sensho* 7 *Hoshasen Keisokugaku*, Chapter 6, Paragraph 3, pp. 182 to 183 (Shoukabo Gomei Kaisha); and the like).

However, because of a disadvantage that the amidol-developing agent, which is readily oxidized, requires preparation of a developer just before use, there is needs for development of a new processing solution for nuclear plates that is excellent in both stability and handling properties, and suitable for processing a lot of dry plates.

SUMMARY OF THE INVENTION

The present invention is a silver halide emulsion sheet for use in detecting track of charged elementary particles, that comprises at least one silver halide emulsion layer and at least one hydrophilic protective colloid layer, on both respective surfaces of a transparent support, in which a compound selected from benzotriazoles is contained in said at least one silver halide emulsion layer.

Further, the present invention is a processing method of a silver halide emulsion sheet for use in detecting track of charged elementary particles, in which the above-said silver halide emulsion sheet for use in detecting track of charged elementary particles is processed with a developer comprising, as a developing agent, a compound represented by formula (A):

formula (A)

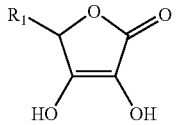

wherein $R_1$ represents a hydrogen atom, an alkyl group, an aryl group, or a heterocyclic group.

Further, the present invention is a developer for use in developing the above-said silver halide emulsion sheet for detecting track of charged elementary particles, which developer comprises, as a developing agent, a compound represented by the above-mentioned formula (A).

Other and further features and advantages of the invention will appear more fully from the following description.

DETAILED DESCRIPTION OF THE INVENTION

The following means are provided according to the present invention.

(1) A silver halide emulsion sheet for detecting track of charged elementary particles, comprising at least one silver halide emulsion layer and at least one hydrophilic protective colloid layer on both respective sides of a transparent support, in which a compound selected from benzotriazoles is contained in said at least one silver halide emulsion layer.

(2) A silver halide emulsion sheet for detecting track of charged elementary particles, comprising at least one silver halide emulsion layer and at least one hydrophilic protective colloid layer on both sides of a transparent support, in which a compound selected from benzotriazoles is contained in said at least one silver halide emulsion layer in an amount of $1\times10^{-3}$ to $1\times10^{-2}$ mole per mole of silver.

(3) The silver halide emulsion sheet for detecting track of charged elementary particles according to the proceeding item (1) or (2), in which a coating amount of silver halide is 0.1 to 1.0 mole/$m^2$ per one side, a coating amount of gelatin is 10 to 100 g/$m^2$ per one side, and each of the hydrophilic protective colloid layers contains a matte agent of 2 μm or less in terms of average grain size.

(4) The silver halide emulsion sheet for detecting track of charged elementary particles according to any one of the proceeding items (1), (2) and (3), in which a silver halide emulsion in the silver halide emulsion layer comprises silver bromide or silver iodobromide, and the silver halide emulsion is a monodispersed emulsion comprising silver halide grains having a grain size of 0.1 to 0.3 μm.

(5) A processing method that comprises processing the silver halide emulsion sheet for detecting track of charged elementary particles according to any one of the proceeding items (1) to (4), with a developer comprising, as a developing agent, a compound represented by formula (A):

formula (A)

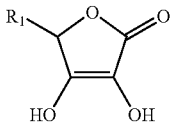

wherein $R_1$ represents a hydrogen atom, an alkyl group, an aryl group, or a heterocyclic group.

(6) A developer for use in developing the silver halide emulsion sheet for detecting track of charged elementary particles according to any one of the proceeding items (1) to (4), that comprises, as a developing agent, a compound represented by the above-mentioned formula (A).

Used as a transparent support for use in the present invention is a 50 to 300 μm thick glass plate or film made of cellulose triacetate, cellulose diacetate, nitro cellulose, polystyrene, polyethylene terephthalate, polyethylene naphthalate, and the like. Particularly cellulose triacetate, polystyrene, and polyethylene terephthalate are preferable. These supports may be subjected to a corona discharge treatment according to a known method. Besides, they may be subjected to an undercoating treatment according to a known method, if necessary. In order to enhance a dimensional stability to a change of temperature and/or moisture, a waterproof layer containing a polyvinylidene chloride-series polymer may be applied onto the support.

The halogen composition of the silver halide emulsion for use in the present invention is preferably silver bromide or silver iodobromide, which is high in electron density inside crystal. Silver chloride is not preferable because it easily increases fogging and moreover has low track sensitivity to charged particles. In the case of using silver iodobromide, the silver iodide content is preferably 5 mole % or less, more preferably in the range of 0.05 to 3.0 mole %.

The larger the grain size is, the higher the sensitivity in each of the grains is. However, since the number of grains per unit volume reduces along with the size increases, the number of developed silver grains (in other words, grain density) decreases. Accordingly, it is preferable to use an emulsion having a grain size of 0.4 μm or less. It is more preferable to use a monodispersed emulsion, which is composed of silver halide grains having a grain size of 0.1 to 0.3 μm, and which has a coefficient of variation of grain size being 20% or less, and preferably 15% or less. The coefficient of variation is represented by (standard deviation of grain size/average grain size)×100. The shape of silver halide grains is preferably cube, octahedron, or tetradecahedron.

The coating amount of the silver halide emulsion varies in accordance with various intended purposes when using the silver halide emulsion sheet for detecting a track of charged elementary particles. Too thin coating makes it difficult to read a track. In contrast, too much coating raises a difficulty in drying when producing the emulsion sheets in large quantities. From the above-mentioned viewpoints, the coating amount of silver halide is preferably 0.1 to 1.0 mole per square meter for one side. The coating amount of a gelatin binder is preferably 10 to 100 g/$m^2$. The coating thickness is preferably 20 to 100 μm. In the case of a large coating amount, coating can be conducted dividing the amount into 2 to 4 portions and subsequently coating them.

The silver halide emulsion sheet of the present invention has a hydrophilic protective colloid layer, in addition to an emulsion layer. The protective colloid layer preferably contains a matte agent having an average grain size of 2 μm or less, and preferably of 0.5 to 2 μm. This is for the purpose of preventing abrasion fog from generating in the course of production of the silver halide emulsion sheet or in handling the produced sheet, and also of preventing films (the produced sheet) from adhering to each other. Matte agents having an average grain size of greater than 3 μm are not preferable because they give an adverse influence to an investigation of the track, and further they generate a black spot-like pressure-induced fog when these sheets are piled up. The thickness of the protective colloid layer is preferably 0.5 to 2 μm. It is preferable that the protective colloid layer is coated on a silver halide emulsion layer.

The addition amount of the matte agent to the protective colloid layer is preferably 10 to 100 mg per $cm^3$ of protective layer volume.

Used as the matte agent are homopolymers of polymethylmethacrylate, copolymers of methyl methacrylate and methacrylic acid, silica, barium sulfate, strontium sulfate, or magnesium oxide, as described in U.S. Pat. Nos. 2,701,245, 2,992,101, 4,142,894 and 4,396,706.

The silver halide emulsion layer contains a compound selected from benzotriazoles. The compound selected from benzotriazoles is preferably contained in an amount of $1\times10^{-3}$ to $1\times10^{-2}$ mole per mole of silver. Specific examples of the benzotriazole compound include 5-methylbenzotriazole, 5-buthylbenzotriazole, 5-chlorobenzotriazole, 5-bromobenzotriazole, 5,6-dimethylbenzotriazole, 5,6-dichlorobenzotriazole, 4,6-dichlorobenzotriazole, 5-nitrobenzotriazole, 4-nitro-6-chlorobenzotriazole, 5-carboxybenzotriazole, 5-aminobenzotriazole, 5-sulfobenzotriazole, benzotriazole, and 4,5,6-trichlorobenzotriazole. Among these compounds, 5-methylbenzotriazole and benzotriazole are particularly preferable. It is first discovered by the present inventor that the benzotriazole compound is an additive effective to prevent fog formation from increasing, and to eliminate undesired tracks formed upon exposure to cosmetic rays, with efficiently destroying latent image nuclei composed of silver nuclei, under high humidity condition. In other words, the present invention provides a silver halide emulsion sheet for detecting track of charged elementary particles, that comprises a silver halide emulsion layer in which regression of latent image is substantial under the high humidity condition while photographic properties are stable under the condition ranging from ordinary humidity to low humidity (65% or less), and the sensitivity is not changed after a latent image regression treatment.

Various compounds may be added to the silver halide emulsion sheet of the present invention for suppression of fogging during production, storage, or processing, or for stabilization of photographic properties. The compounds to be added are preferably selected from many compounds known as an anti-fogging agent or a stabilizer, such as mercapto tetrazoles, mercapto pyrimidines, mercapto triazines, oximes, azaindenes, dihydroxybenzenes, dihydroxynaphthalenes, benzene thiosulfonic acids, and benzene sulfonic acids.

The silver halide emulsion for use in the present invention can be prepared according to various methods known in the field of silver halide emulsion. The emulsion can be prepared adapting methods, as disclosed, for example, in P. Glafkides, *Chimie et Physique Photographyque*, Paul Montel (1976), G. F. Duffin, *Photographic Emulsion Chemistry*, The Focal Press (1966), V. L. Zelikman et al., *Making and Coating Photographic Emulsion*, The Focal Press (1964).

Style of reacting a water-soluble silver salt (an aqueous solution of silver nitrate) and a water-soluble halide to obtain silver halide grains, may be a single-jet method, a double-jet method, or a combination thereof. As one style of the double-jet method, use can be made of a controlled double-jet method wherein the silver ion concentration of the solution, in which silver halide is formed, is maintained at a constant value. Also, silver halide grains may be formed using a so-called silver halide solvent such as ammonia, thioethers, thiourea compounds, and thiazoline thiones. The above-mentioned controlled-double-jet method and the method of forming silver halide grains using a silver halide solvent are useful means for obtaining a monodisperse silver halide emulsion having a regular crystal form and a sufficiently uniform grain size distribution.

At the formation step of the silver halide grains, a salt or complex salt of VIII group metal such as iridium, rhodium, ruthenium, and iron may be added to dope in the silver halide crystal. Doping iridium or iron complex salts is effective means to increase sensitivity to charged particles (indicated by GD).

The silver halide emulsion for use in the present invention may be subjected to gold sensitization and sulfur sensitization. The gold sensitization and the sulfur sensitization are effective to increase sensitivity. Examples of gold sensitizer include potassium chloroaurate, potassium auric thiocyanate, auric trichloride, and the like. Examples of sulfur sensitizer include various sulfur compounds such as thiosulfate salts, thioureas, thiazoles, and thiosulfonic acids.

A preferable addition amount of the gold sensitizer and the sulfur sensitizer may vary in accordance with temperature, time and pH at the time of chemical ripening and also with a size of the silver halide grains. However, they are preferably used in the range of $10^{-7}$ to $10^{-2}$ mole per mole of silver.

An inorganic or organic gelatin hardener may be added to a silver halide emulsion layer and a hydrophilic protective colloid layer according to the present invention. Examples of the hardeners include aldehydes (e.g., formaldehyde, glyoxal, glutaraldehyde), active vinyl compounds (e.g., 1,3-divinylsulfonyl-2-propanol, 1,2-bis(vinylsulfonylacetamido)ethane, bis(vinylsulfonyl)methane, 1,3,5-triacryloylhexahydro-s-triazine), active halogen compounds (e.g., 2,4-dichloro-6-hydroxy-s-triazine), chromium salts (e.g., chromium alum, chromium acetate), and mucochlomic acid. Of these compounds, active vinyl compounds and active halogen compounds are preferably used.

The silver halide emulsion layer and hydrophilic protective colloid layer according to the present invention may contain various additives known and employed in photographic light-sensitive material, such as surface active agent, antistatic agent, sliding property modifier, plasticizer, pH-adjusting agent, development accelerator, and the like.

Next, a processing method of the silver halide emulsion sheet for use in detecting track of charged elementary particles according to the present invention is explained below.

A method of using an amidol-developing agent, that is known as an existing processing method for nuclear sheet, can be also applied to a processing of the silver halide emulsion sheet of the present invention. However, as mentioned above, the amidol-developing agent that easily oxidizes has a disadvantage that a developer containing the agent must be prepared just before use.

In contrast, a stable processing can be performed with good reproduction by a developer containing an ascorbic acid or its derivative represented by formula (A) as a developing agent.

Formula (A)

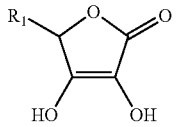

In formula (A), the alkyl group represented by $R_1$ is a straight chain, branched chain, or cyclic alkyl group having 1 to 10 carbon atoms. The aryl group represented by $R_1$ is an aryl group having 6 to 10 carbon atoms, for example, a phenyl or naphthyl group. The heterocyclic group represented by $R_1$ is preferably a 5- to 6-membered hetero ring comprising a carbon, nitrogen, oxygen, or sulfur atom. These groups may have a substituent. Among these groups, an alkyl group substituted with a hydroxyl group is preferable.

A developer containing an ascorbic acid or its derivative represented by formula (A) has been practically used as a solution for processing a radiation-sensitive material and a photosensitive material for graphic arts. However, the present inventor has first discovered that, in the processing of the nuclear plate, the above-said developer is also effective such that the development provides a few fogging and an equal track sensitivity, under the same conditions as for the development using an amidol-developing agent.

Specific examples of the compounds are shown below.

A-1

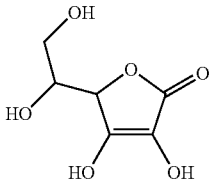

A-2

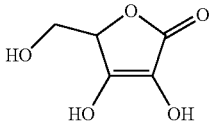

A-3

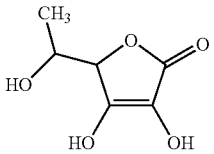

A-4

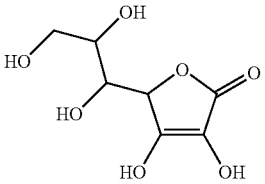

-continued

A-5

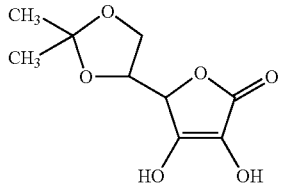

A-6

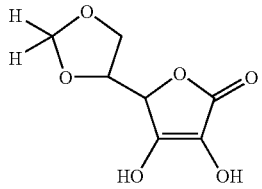

A-7

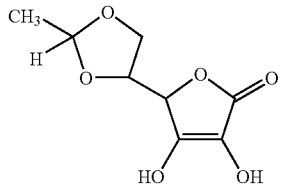

A-8

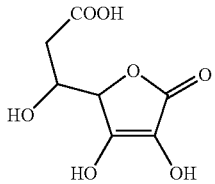

A-9

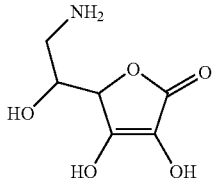

A-10

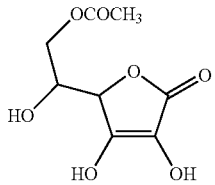

A-11

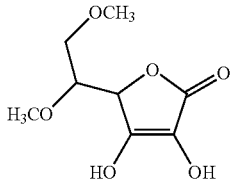

A-12

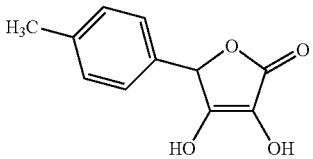

-continued

A-13

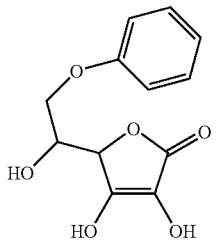

A-14

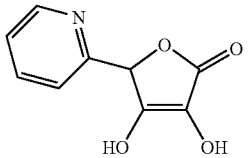

A-15

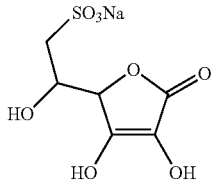

The compound represented by formula (A) is generally used in an amount of 0.03 mole to 0.5 mole, preferably 0.05 to 0.3 mole, per liter of a working developing solution.

In the developer used in the processing method of the present invention, compounds selected from the group consisting of 3-pyrazolidones (e.g., 1-phenyl-3-pyrazolidone, 1-phenyl-4-methyl-4-hydroxymethyl-3-pyrazolidone) and aminophenols (e.g., N-methyl-p-aminophenol) may be used in combination as an auxiliary developing agent. The addition amount of the auxiliary developing agent is preferably 0.06 mole/liter or less.

Further, known compounds such as a preservative (for example, sulfites), an alkali agent that is used for pH setting (for example, sodium hydroxide, potassium hydroxide), a pH buffer (for example, carbonate, borate, phosphate, sulfo salicylic acid), an antifoggant, a development inhibitor (for example, KBr), an organic solvent, a development accelerator, a sliver stain inhibitor, a surfactant, a toning agent, an antifoam agent, a hardener, and a chelating agent may be contained.

The pH of the developer is preferably 8 or higher, more preferably in the range of 9 to 10.5, in a working solution. Among the pH buffers, carbonates are preferable. The addition amount of the carbonate is preferably in the range of 0.1 to 1.0 mole, more preferably in the range of 0.15 to 0.6 mole, per liter of a working solution.

The amount of the sulfite to be added as a preservative is generally 0.01 mole or more, preferably in the range of 0.02 to 0.5 mole, per liter of a working solution.

It is also effective, from the viewpoint of storage stability of the solution, to prepare a concentrate of the developer in advance and use it with diluting to a desired concentration at the time of use.

In the fixation of the processing method according to the present invention, any known fixing solution that is used to process a general black and white photographic light-sensitive material may be used. As the fixing agent, thiosulfate such as ammonium thiosulfate and sodium thiosulfate is preferably used. The thiosulfate is ordinarily used in an amount of 0.2 to 3.0 mole, preferably 0.5 to 1.5 mole, per liter of a working solution. As the preservative, thiosulfite is generally used. As the hardener, a water-soluble aluminum salt is generally used.

Further, other additives such as pH adjusting agents (for example, acetic acid, citric acid, tartaric acid, malic acid, and gluconic acid), stabilizers for aluminum ions, chelating agents (for example, aminocarboxyric acids) may be contained.

One of effective means when processing the silver halide emulsion sheet for use in detecting track, according to the present invention, is a method wherein a swelling film thickness of the emulsion layer during processing is controlled, by immersing the silver halide emulsion sheet in an aqueous solution containing sodium sulfate, potassium sulfate, or aldehydes before the silver halide emulsion sheet enters into a developer. Besides, it is ordinary to pass a dry plate through a stop bath containing acetic acid in between the developing step and the fixing step, and addition of aldehydes or water-soluble aluminum salts to the above-said stop bath makes it possible to control a swelling film thickness.

The processing time and temperature in each of processing steps including presoaking, development, stop, fixing and washing are not particularly limited. However, it is preferable to carry out these processing at 25° C. or less, more preferably 22° C. or less, because a high temperature processing is apt to cause emulsion loosening, generation of reticulation or blister, and deterioration of distortion.

The silver halide emulsion and sheet for use in detecting and recording track of charged elementary particles according to the present invention is excellent in fading treatment suitability, resulting in enhancement of the reliability of recording and detecting track of target charged elementary particles. Accordingly, this silver halide emulsion sheet as a nuclear plate is excellent in both stability and handling properties. According to the present invention, nuclear plates can be produced in large quantities.

Further, a stable processing of the nuclear plate can be performed by the processing method of the present invention. Besides, a developer containing a compound represented by formula (A) is remarkably suitable for a processing of the nuclear plate.

The present invention is explained in more detail with reference to the following Examples.

EXAMPLES

Example 1

[Preparation of Silver Halide Emulsion]

A silver halide emulsion was prepared according to the following method.

| | | |
|---|---|---|
| Solution 1 | | |
| Water | 40 | liter |
| Gelatin | 900 | g |
| Potassium bromide | 30 | g |
| 3,4-Dimethylthiazoline-2-thione | 0.8 | g |
| Sodium benzenethiosulfonate | 0.1 | g |
| Solution 2 | | |
| Water | 10 | liter |
| Silver nitrate | 12.5 | mole |
| Ammonium nitrate | 250 | g |

-continued

| | |
|---|---|
| Solution 3 | |
| Water | 10 liter |
| Potassium bromide | 12.6 mole |
| Potassium iodide | 0.5 mole |
| Ammonium nitrate | 250 g |
| Solution 4 | |
| Water | 7 liter |
| Silver nitrate | 12.5 mole |
| Ammonium nitrate | 250 g |
| Solution 5 | |
| Water | 7 liter |
| Potassium bromide | 13.0 mole |
| Potassium ferricyanide (1%) | $1.5 \times 10^{-3}$ mole |

The above-described solutions 1 to 5 were prepared. To the solution 1 maintained at 55° C., the solution 2 and the solution 3 were added with stirring over 30 minutes according to a double jet method, thereby forming nuclear grains. Subsequently the solution 4 and the solution 5 were added with stirring over 20 minutes while maintaining pAg at 8.5 according to a controlled double jet method. Addition of the solution 5 was finished at the same time as the solution 4.

Thereafter, washing was carried out by flocculation method according to an ordinary method. 1300 g of gelatin was further added and the pH was adjusted to 6.5. Then, 0.1 g of sodium thiosulfate, 0.25 g of chloroauric acid and 0.5 g of sodium benzenethiosulfonate were added, and the resultant emulsion was subjected to chemical sensitization at 60° C. for 50 minutes. 100 g of phenoxyethanol as antiseptics was added to obtain 20 kg of emulsion.

The formed silver iodobromide grains formed a monodispersed emulsion having average grain size of 0.2 μm, and coefficient of variation of 9%.

[Preparation of Coated Sample (A-I)]

To 1 kg of the emulsion thus obtained, the following compounds were added and mixed to prepare an emulsion layer-coating solution (a): 0.6 g of 5-methylbenzotriazole (equivalent to $3.6\times10^{-3}$ mole per mole of silver); 4.5 g of tris(2-hydroxyethyl)isocyanurate as a plasticizer; 10 mg of 1-phenyl-5-mercaptotetrazole, 1.0 g of 1,5-dihydroxy-2-benzaldoxime, and 0.25 g of 2,3-dihydroxynaphthalene as anti-foggants and stabilizers; 0.25 g of 1,2-bis(vinylsulfonylacetamido)ethane as a hardener.

A coating solution for a hydrophilic protective colloid layer was prepared adding to gelatin the following compounds: 3.5 g of phenoxyethanol as an antiseptic, 10 g of colloidal silica having grain diameter of 10 to 20 nm, 1 g of sodium p-dodecylbenzene sulfonate, and 0.3 g of N-perfluorooctane sulfonyl-N-propylglycine, and further 4 g of strontium sulfate having average grain size of 1 μm as a matte agent, per 100 g of gelatin respectively. The resultant coating solution herein is referred to as a protective layer-coating solution (I).

On a cellulose triacetate transparent support of 200 μm thick, there were coated and dried the thus-prepared emulsion layer-coating solution (a) so that a silver amount became 25 g/m$^2$ and the thus-prepared protective layer-coating solution (I) so that a gelatin amount became 1.0 g/m$^2$. Each of these coatings was repeated twice on both surfaces of the transparent support. After drying, moisture conditioning was carried out under the conditions of 25° C. and 60% humidity, to prepare the coated sample (A-I) having a silver amount of 50 g/m$^2$ and a film thickness of 45 μm (gelatin amount: about 35 g/m$^2$) per one side.

[Preparation of Coated Samples (B-I) and (C-I)]

An emulsion layer-coating solution (b) having the same composition as that of the emulsion layer-coating solution (a) was prepared, except that 5-methylbenzotriazole was not included. Similarly an emulsion layer-coating solution (c) was prepared in the same manner as the emulsion layer-coating solution (a), except that the amount of 5-methylbenzotriazole was altered to 0.1 g (equivalent to $0.6\times10^{-3}$ mole per mole of silver). Then, coated sample (B-I) and (C-I) were prepared in the same manner as the coated sample (A-I), except that the emulsion layer-coating solution (b) and (c) were used in combination with the protective layer-coating solution (I), respectively.

[Irradiation of Electron Rays]

Each of coating samples (A-I), (B-I) and (C-I) thus-obtained was packed in a light-shielding bag laminated with polyethylene, and vacuum-aspirated to seal. Thereafter, electron rays of tens of MeV were irradiated in parallel with the sample. In this case, electron rays longitudinally pass through the silver halide emulsion layer.

[Photographic Processing]

These electron ray-irradiated samples were processed according to the following steps.

| | | |
|---|---|---|
| 1. Presoaking solution | 20° C. | 15 min. |
| 2. Developing solution | 20° C. | 25 min. |
| 3. Stopping solution | 20° C. | 10 min. |
| 4. Fixing solution | 20° C. | 30 min. |
| 5. Washing | 20° C. | 30 min. |
| 6. Drying | 20° C. | Air dry at relative humidity of 60% |

The formulation of each processing solution is presented below.

| | |
|---|---|
| 1. Presoaking solution | |
| Sodium sulfate | 70 g |
| Ion-exchanged water | 1 liter |
| 2. Developing solution | |
| Developing agent (A-1) | 60 g |
| Diethylenetriamine-5-acetic acid | 8 g |
| Potassium bromide | 12 g |
| Sodium sulfite | 20 g |
| Potassium carbonate | 70 g |
| Sodium carbonate | 40 g |
| 4-Methyl-4-hydroxymethyl-1-phenyl-3-pyrazolidone | 12 g |
| 2,5-Dimercapto-1,3,4-thiadiazole | 0.2 g |
| 3,3'-Dithiobishydrocinnamic acid | 1.4 g |
| Diethylene glycol | 50 g |
| NaOH and water were added to make 1 liter, with adjusting pH to 9.8. Three parts of water is further added to one part of this solution (volume ratio) to make a working solution. | |
| 3. Stopping solution | |
| A solution obtained by adding, to 5% acetic acid solution, 5 g/l of aluminum sulfate. | |
| 4. Fixing solution | |
| Ammonium thiosulfate | 120 g |

-continued

| | |
|---|---|
| Disodium ethylenediamine tetraacetate dihydrate | 0.03 g |
| Sodium thiosulfate pentahydrate | 11 g |
| Sodium sulfite | 24 g |
| Tartaric acid | 3 g |
| Sodium gluconate | 2 g |
| Aluminum sulfate | 8 g |
| Sodium acetate | 38 g |

Sulfuric acid and water were added to make 1.0 liter of a solution, with adjusting pH to 4.8

Next, the following test was also carried out.

In order to eliminate latent images of electron ray tracks, the same samples as the foregoing electron ray-irradiated samples were stood under the temperature/humidity conditions of 30° C./90% for 3 days, and then moisture conditioning was carried out under the conditions of 25° C. and 60% RH to effect a refresh treatment. Thereafter, these samples were processed in the same manner as described above.

Besides, the following another test was also carried out.

The above-described samples (A-I), (B-I) and (C-I) before electron ray-irradiation were stood at the temperature/humidity conditions of 30° C./90% for 3 days, and then moisture conditioning was carried out under the conditions of 25° C. and 60% RH. Thereafter, these samples were packed in light-shielding bags, and irradiated by electron rays, and then processed in the same manner as the above processing.

Observation of each of these processed samples was made by means of a microscope manufactured by Keyence Corporation, and the number of developed grains per 100 μm of electron ray track (GD) and the number of fog grains per 1000 $\mu m^3$ (FD) were measured and evaluated.

The results thus obtained are shown in Table 1.

GD refers to the number of developed grains per 100 μm of electron ray track. The larger the value of GD is, the higher the sensitivity is. FD refers to the number of fog grains per 1000 $\mu m^3$ of emulsion volume at the portion where there is neither electron ray track nor track owing to exposure to cosmic rays.

It is desirable that the value of FD is as low as possible. If the value is 10 or more, discrimination of track becomes difficult. Therefore, the value of FD is preferably 8 or less, more preferably 6 or less.

In the table 1, "Evaluation" shows the worst rating among the ratings of GD and FD for the sample. "Overall Evaluation" shows the worst rating in the preceding evaluations for each sample. GD and FD were rated as follows.

| | Sample | Rating ○ | Rating Δ | Rating X |
|---|---|---|---|---|
| GD | For samples before refresh treatment or samples further irradiated with electron rays after refresh treatment | 32 or more | 31 to 25 | 24 or less |
| | For samples after refresh treatment but not further irradiated with electron rays | 10 or less | 11 to 20 | 21 or more |
| FD | For all samples | 6 or less | 7 to 9 | 10 or more |

TABLE 1

| | Sample No. A-1 (This invention) | Sample No. B-1 (Comparative sample) | Sample No. C-1 (This invention) |
|---|---|---|---|
| Stored samples dried on the conditions of 25° C./60% after irradiation of electron rays | GD = 36<br>FD = 2<br>Evaluation ○ | GD = 37<br>FD = 5<br>Evaluation ○ | GD = 36<br>FD = 3<br>Evaluation ○ |
| Samples subjected to a refresh treatment of 30° C./90% for 3 days after irradiation of electron rays | GD = 8<br>FD = 3<br>Evaluation ○ | GD = 22<br>FD = 12<br>Evaluation X | GD = 17<br>FD = 7<br>Evaluation Δ |
| Samples treated on the conditions of 30° C./90% for 3 days before irradiation of electron rays | GD = 34<br>FD = 3<br>Evaluation ○ | GD = 36<br>FD = 12<br>Evaluation X | GD = 34<br>FD = 7<br>Evaluation Δ |
| Overall Evaluation | ○ | X | Δ |

Sample A-1 of the present invention was sufficiently low in FD. The refresh treatment of 30° C./90% RH for 3 days eliminated tracks in Sample A-1 to the level where GD was 10 or less. This is a level difficult to find tracks formed upon exposure to undesired cosmic rays. Further, even after the refresh treatment, Sample A-1 exhibited small FD and less reduction of GD. Therefore, Sample A-1 had a fully satisfactory capacity as a silver halide emulsion sheet for use in detecting track of charged elementary particles. In contrast, Comparative sample B-1 free from 5-methylbenzotriazole insufficiently eliminated tracks by the refresh treatment, and increase in the number of fogged grains (FD) was remarkable. Beside, Comparative sample C-1, to which 5-methylbenzotriazole was added in an amount corresponding to $0.6\times10^{-3}$ mole per mole of silver, showed a tendency to improve FD (the fog level was lowered), but elimination of the tracks was unsatisfactory.

Example 2

[Preparation of Coated Sample (A-II)]

Coated sample (A-II) was prepared in the same manner as the coated sample (A-I), except that the protective layer coating solution (I) was replaced by a coating solution (II) containing 4 g of a silica matte agent having the average grain size of 3.5 μm.

In the same manner as in Example 1, the coated samples (A-I) of Example 1 and (A-II) of Example 2 were packed in light-shielding bags laminated with polyethylene, vacuum-aspirated to seal, and then irradiated by electron rays of tens of MeV in parallel with the sample.

The processing was carried out in the same manner and conditions as in Example 1.

Observation of each of these processed samples was made by means of a microscope manufactured by Keyence Corporation.

In the case of sample (A-II), in which a silica matte agent of 3.5 μm in terms of average grain size was used, generation of black spot-like pressure fog owing to the matte agent was observed on the surface of the sample. In contrast, no black spot-like pressure fog was observed in the sample (A-1) of the present invention.

Example 3

The sample (A-1) prepared according to the method of Example 1 was irradiated by electron rays in the same manner as in Example 1. Thereafter, the sample was processed according to the same processing steps as in Example 1, except that the developer was replaced with the following the developer 1-1, 1-2, 2-1, and 2-2, respectively.

Developer Formulation 1-1:

the same developer formulation as of Example 1, that is the developing solution (working solution) obtained by diluting the concentrate of the developing solution with water in the proportion of the concentrate to water at 1 to 3 (by volume) just before processing.

Developer Formulation 1-2:

the same solution as of the working solution of Developer formulation 1-1, except that 1 liter of the solution was contained in a vessel so that the depth of the solution became 5 cm, and the solution was left in contact with air at 25° C. for 24 hours.

Developer Formulation 2-1:

| | |
|---|---|
| Developing agent: Amidol | 3.0 g |
| Sodium sulfite | 12.0 g |
| Potassium bromide | 0.4 g |

Water was added to make 1 liter of solution just before use, and pH was adjusted to 6.7

Developer Formulation 2-2:

the same solution as of the solution of Developer formula 2-1, except that 1 liter of the solution was contained in a vessel so that the depth of the solution became 5 cm, and the solution was left in contact with air at 25° C. for 24 hours.

Observation of each of these processed samples was made by means of a microscope manufactured by Keyence Corporation, and the number of developed grains per 100 μm of electron ray track (GD) and the number of fogged grains per 1000 $\mu m^3$ (FD) were measured and evaluated.

The results obtained are shown in Table 2.

TABLE 2

| | Developer 1-1 | Developer 1-2 | Developer 2-1 | Developer 2-2 |
|---|---|---|---|---|
| GD value | 36 | 35 | 35 | 22 |
| FD value | 2 | 2 | 3 | 2 |
| Overall evaluation | ○ | | Δ | |

From the above results, it is apparent that in the case of using the Developer 1-1 and Developer 1-2, reduction of GD owing to air oxidation was small and the processing that employed the developer was excellent in stability. In contrast, it is apparent that the developer containing the amidol developing agent were able to exhibit properties almost level with Developer 1-1 when used immediately after the preparation (Developer 2-1), however use of the air oxidized solution of Developer 2-2 reduced sensitivity and thus resulted in deteriorated stability.

Having described our invention as related to the present embodiments, it is our intention that the invention not be limited by any of the details of the description, unless otherwise specified, but rather be construed broadly within its spirit and scope as set out in the accompanying claims.

What I claim is:

1. A silver halide emulsion sheet for use in detecting track of charged elementary particles, comprising at least one silver halide emulsion layer and at least one hydrophilic protective colloid layer, on both respective sides of a transparent support, wherein a compound selected from benzotriazoles in an amount of $1\times10^{-3}$ mole or more per mole of silver is contained in said at least one silver halide emulsion layer.

2. The silver halide emulsion sheet as claimed in claim 1, wherein the compound selected from benzotriazoles is contained in an amount of $1\times10^{-2}$ to $1\times10^{-2}$ mole per mole of silver.

3. The silver halide emulsion sheet as claimed in claim 1, wherein a coating amount of silver halide is 0.1 to 1.0 mole/$m^2$ per one side, a coating amount of gelatin is 10 to 100 g/$m^2$ per one side, and each of the hydrophilic protective colloid layers contains a matte agent having an average grain size of 2 μm or less.

4. The silver halide emulsion sheet as claimed in claim 1, wherein a silver halide emulsion in the silver halide emulsion layer comprises silver bromide or silver iodobromide, and the silver halide emulsion is a monodispersed emulsion comprising silver halide grains having a grain size of 0.1 to 0.3 μm.

5. The silver halide emulsion sheet as claimed in claim 4, wherein the silver halide emulsion in the silver halide emulsion layer comprises silver iodobromide comprising silver iodide of 5 mole % or less.

6. The silver halide emulsion sheet as claimed in claim 1, wherein the compound selected from benzotriazoles is a compound selected from the group consisting of 5-methylbenzotriazole, 5-buthylbenzotriazole, 5-chlorobenzotriazole, 5-bromobenzotriazole, 5,6-dimethylbenzotriazole, 5,6-dichlorobenzotriazole, 4,6-dichlorobenzotriazole, 5-nitrobenzotriazole, 4-nitro-6-chlorobenzotriazole, 5-carboxybenzotriazole, 5-aminobenzotriazole, 5-sulfobenzotriazole, benzotriazole, and 4,5,6-trichlorobenzotriazole.

7. The silver halide emulsion sheet as claimed in claim 1, wherein a coating thickness for the silver halide emulsion layer is 20 to 100 μm per one side of the silver halide emulsion sheet.

8. The silver halide emulsion sheet as claimed in claim 1, wherein the at least one hydrophilic protective colloid layer has a thickness of 0.5 to 2 μm.

9. The silver halide emulsion sheet as claimed in claim 1, wherein the silver halide emulsion layer contains silver halide grains having a shape of cube, octahedron, or tetradecahedron.

10. The silver halide emulsion sheet as claimed in claim 1, wherein the silver halide emulsion has a halogen composition containing silver bromide or silver iodobromide.

* * * * *